US010722898B2

(12) United States Patent
Arima et al.

(10) Patent No.: US 10,722,898 B2
(45) Date of Patent: Jul. 28, 2020

(54) VERTICAL ROLLER MILL

(71) Applicant: MITSUBISHI HITACHI POWER SYSTEMS, LTD., Yokohama-shi (JP)

(72) Inventors: Kenichi Arima, Tokyo (JP); Shinji Matsumoto, Tokyo (JP); Takuichiro Daimaru, Tokyo (JP); Kiyonori Kushioka, Tokyo (JP); Keishi Suga, Tokyo (JP)

(73) Assignee: MITSUBISHI HITACHI POWER SYSTEMS, LTD., Yokohama-Shi (JP)

( * ) Notice: Subject to any disclaimer, the term of this patent is extended or adjusted under 35 U.S.C. 154(b) by 738 days.

(21) Appl. No.: 14/909,789

(22) PCT Filed: Aug. 19, 2014

(86) PCT No.: PCT/JP2014/071679
§ 371 (c)(1),
(2) Date: Feb. 3, 2016

(87) PCT Pub. No.: WO2015/064185
PCT Pub. Date: May 7, 2015

(65) Prior Publication Data

US 2016/0199844 A1 Jul. 14, 2016

(30) Foreign Application Priority Data

Nov. 1, 2013 (JP) ..... 2013-228354
Nov. 22, 2013 (JP) ..... 2013-242059

(51) Int. Cl.
*B02C 15/00* (2006.01)
*B02C 23/30* (2006.01)
*B07B 7/086* (2006.01)

(52) U.S. Cl.
CPC ..... *B02C 15/00* (2013.01); *B02C 15/001* (2013.01); *B02C 23/30* (2013.01); *B07B 7/086* (2013.01); *B02C 2015/002* (2013.01)

(58) Field of Classification Search
CPC ... B02C 2015/002; B02C 15/00; B02C 15/02; B02C 15/001; B02C 23/26; B02C 23/30
(Continued)

(56) References Cited

U.S. PATENT DOCUMENTS 5,667,149 A 9/1997 Eisinger
6,231,273 B1 5/2001 Amieux
(Continued)

FOREIGN PATENT DOCUMENTS

CN 1271077 10/2000
CN 1564718 1/2005
(Continued)

OTHER PUBLICATIONS

English Machine Translation of WO2012026422A1 (Year: 2012).*
(Continued)

*Primary Examiner* — Shelley M Self
*Assistant Examiner* — Katie L. Parr
(74) *Attorney, Agent, or Firm* — Wenderoth, Lind & Ponack, L.L.P.

(57) ABSTRACT

A vertical roller mill provided with a cyclone-type fixed separator that separates fine powder and allows the separated powder to flow out to the outside, the cyclone-type fixed separator being provided inside a housing, wherein the fixed separator is configured so that a solid-gas two-phase flow is introduced from a fixed blade inlet window opening on a cone into the inside and the solid-gas two-phase flow is swirled using a fixed blade attached in the inside vicinity of the fixed blade inlet window, whereby the fine powder flows out to the outside from a pulverized coal outlet in an upper
(Continued)

portion of the vertical roller mill through the lower end side of an inner cylinder provided inside the cone, a surface layer in which the rebound coefficient of collided particles is higher than in an iron plate surface being formed in the outer surface of the inner cylinder.

1 Claim, 7 Drawing Sheets

(58) Field of Classification Search
USPC ..... 241/47, 52, 61, 68, 79, 221, 222, 292.1
See application file for complete search history.

(56) References Cited

U.S. PATENT DOCUMENTS

| | | | | |
|---|---|---|---|---|
| 7,762,484 | B2 * | 7/2010 | Johnson | E04F 21/085 241/134 |
| 8,622,328 | B2 * | 1/2014 | Matsumoto | B07B 7/02 241/119 |
| 2003/0034278 | A1 | 2/2003 | Laux | |
| 2012/0138718 | A1 | 6/2012 | Daimaru et al. | |
| 2013/0284644 | A1 | 10/2013 | Baetz et al. | |
| 2013/0334350 | A1 * | 12/2013 | Wong | A47J 43/082 241/68 |

FOREIGN PATENT DOCUMENTS

| | | | | |
|---|---|---|---|---|
| CN | 102123798 | | 7/2011 | |
| EP | 0540551 | B1 * | 8/1995 | B01D 45/16 |
| JP | 59-74844 | | 5/1984 | |
| JP | 5-44266 | | 6/1993 | |
| JP | 7-51629 | | 2/1995 | |
| JP | 7-51630 | | 2/1995 | |
| JP | 10-230181 | | 9/1998 | |
| JP | 11-347494 | | 12/1999 | |
| JP | 2000-42439 | | 2/2000 | |
| JP | 2002-18301 | | 1/2002 | |
| JP | 2011-104563 | | 6/2011 | |
| KR | 1987-0003032 | | 4/1987 | |
| WO | 99/10101 | | 3/1999 | |
| WO | 2011/062240 | | 5/2011 | |
| WO | WO-2012026422 | A1 * | 3/2012 | B07B 7/02 |

OTHER PUBLICATIONS

International Search Report dated Dec. 2, 2014 in corresponding International Application No. PCT/JP2014/071679.

Written Opinion of the International Searching Authority dated Dec. 2, 2014 in corresponding International Application No. PCT/JP2014/071679.

First Office Action dated Jan. 23, 2017 in corresponding Chinese Application No. 201480044306.5 (with English translation).

Notification of Reason for Rejection dated Oct. 18, 2016 in corresponding Japanese Application No. 2013-228354 (with English translation).

Notice of Preliminary Rejection dated Nov. 20, 2016 in corresponding Korean Application No. 10-2016-7003296 (with English translation).

Decision to Grant dated Oct. 18, 2016 in corresponding Japanese Application No. 2013-242059.

* cited by examiner

CONVENTIONAL COARSE PARTICLE PATH
COARSE PARTICLE PATH IN EMBODIMENT

VERTICAL ROLLER MILL

TECHNICAL FIELD

The present invention relates to a vertical roller mill applicable to, e.g., a pulverized coal-fired boiler, and particularly to a vertical roller mill equipped with a fixed separator.

BACKGROUND ART

Conventionally in a coal-fired boiler, raw coal is introduced into a coal pulverizer (a mill) such as a vertical roller mill 10 illustrated in FIGS. 7, 8(*a*), and 8(*b*), and pulverized coal is used as fuel. In the vertical roller mill 10, a mill roller 13 rotates while turning on a mill table 12 placed on a lower side in a housing 11. Note that a reference numeral "14" in the figures denotes a coal feed tube through which raw coal is introduced.

Raw coal introduced into the vertical roller mill 10 is crushed between the mill table 12 and the mill roller, and is pulverized into pulverized coal. While being dried by hot air flowed out from a throat 15 arranged to surround the mill table 12, the pulverized coal is delivered to a fixed separator 20 disposed on an upper side in the housing 11 by an air flow. At this point, gravitational separation is performed, in which coarse particles having a large particle size drop down due to the force of gravity and return onto the mill table 12. Thus, the particles are repeatedly pulverized until the particle size thereof reaches a desired particle size.

After the above-described gravitational separation, i.e., primary separation, pulverized coal having product particles including coarse particles is further separated by the separator disposed above the mill table 12. Examples of the above-described separator include a fixed separator, a rotary separator, and a combination thereof. The separator illustrated in the figures is the fixed separator. Note that it has been known that the rotary separator is configured to perform separation using collision/inertia force generated by rotary vanes and exhibits a high separation performance.

The pulverized coal delivered by the flow of air is dried by hot air, and is separated while passing through the fixed separator 20. The separated pulverized coal passes through pulverized coal outlets 16 allowing communication between the inside of the fixed separator 20 and the outside of the housing 11 on the upper side thereof, and then, is delivered to a boiler by the flow of primary air for delivery.

The fixed separator 20 includes many fixed blade inlet windows 22 opening at regular intervals in a circumferential direction on an upper end side of a cone 21. The fixed blade inlet windows 22 are openings formed to penetrate a wall forming the cone 21, and serve as the inlets and flow paths through which the flow (hereinafter referred to as a "solid-gas two-phase flow") of air for delivering pulverized coal flows into the cone 21.

Many fixed blades 23 each paired with a corresponding one of the fixed blade inlet windows 22 are attached to an inner wall side of the cone 21.

Moreover, an inner cylinder 24 forming a wall facing the fixed blade inlet windows 22 and the fixed blades 23 is provided in the cone 21.

All of the fixed blades 23 incline in the same direction in order to swirl the solid-gas two-phase flow. That is, each fixed blade 23 is attached to have an inclination angle θ with respect to a line along a radial direction toward the center of the cone 21. Thus, with an increase/decrease in the inclination angle θ of the fixed blade 23, the strength of the swirl flow also changes according to the opening degree (the angle) of the fixed blade 23. Thus, the fineness of coal targeted for separation can be adjusted.

Note that a reference numeral "25" in the figures denotes a cone outlet through which raw coal and coarse particles separated by the separator 20 are supplied onto the mill table 12.

The above-described fixed separator 20 is a cyclone separator, and has a simple structure without a driver. Thus, the fixed separator 20 has advantages such as low cost and easy maintenance. However, the fixed separator 20 exhibits a poor accuracy in coarse particle size separation, and coarse particles (coarse particles having a size of over 100 mesh and providing an adverse effect to combustibility) contained in pulverized coal increases. This causes an increase in unburnt combustibles contained in combustion exhaust gas discharged from the boiler.

The principle of separation by the fixed separator 20 will be briefly described. Particles of pulverized coal in the solid-gas two-phase flow having passed between adjacent ones of the fixed blades 23 through the fixed blade inlet window 22 are centrifugally separated into coarse particles and fine powder by a swirl flow. Subsequently, the light-weight fine powder having a small particle size rides on and rises with an inverted upward flow from below. Then, the fine powder enters the inner cylinder 24 from below, and flows out from the vertical roller mill 10 through the pulverized coal outlets 16. However, the centrifugalized coarse particles having a large particle size cannot ride, due to a high weight thereof, on the flow entering the inner cylinder 24 from below. For this reason, such particles reach an inner wall of the cone 21, and then, drop down along an inner wall surface of the cone 21 due to the force of gravity.

These coarse particles eventually drop down onto the mill table 12 through the coal feed tube 14 opening at a lower center portion of the cone 21, and are pulverized again.

In order to reduce the proportion of coarse particles in product pulverized coal in the above-described vertical roller mill including the fixed separator, the following conventional techniques are disclosed in Patent Literature 1: drift plates are provided in the vicinity of vane input windows; and inclination of an inner cylinder is changed.

CITATION LIST

Patent Literature

{PTL 1}
Japanese Unexamined Patent Application, Publication No. 2011-104563

SUMMARY OF INVENTION

Technical Problem

As described above, in the fixed separator 20 of the vertical roller mill 10, the fixed blades 23 swirl the solid-gas two-phase flow subjected to gravitational separation after pulverization to separate particles of pulverized coal into coarse particles and fine powder by centrifugal force. A centrifugal effect acting on coarse powder having a particle size (an intermediate particle size of about 150 μm between a coarse particle size and a fine particle size, the particle size causing unburnt combustibles) close to a product particle size is weak. Thus, part of the coarse powder might flow toward the center in the vicinity of the inner cylinder 24 due to an air flow change, and tends to swirl and fall down in the vicinity of the inner cylinder 24. As a result, the probability of mixing the coarse powder in the inverted upward flow containing the fine powder increases. Due to an increase in the amount of coarse powder mixed with the product fine powder, a separation efficiency is disadvantageously lowered.

Two main factors for lowering of the separation efficiency are as follows, for example.

The first factor is that as indicated by a dashed arrow in FIG. 8(*a*), some (a coarse particle Pc in the figure) of coarse particles contained in the solid-gas two-phase flow having passed through the fixed blade inlet window 22 between the fixed blades 23 collide against and rebound off an outer surface (a surface facing the inner wall surface of the cone 21) of the inner cylinder 24, and then, re-collide against the back side (a raised curved surface) of the fixed blade 23.

The second factor is that as indicated by another dashed arrow in FIG. 8(*a*), some (a coarse particle Pd in the figure) of the coarse particles contained in the solid-gas two-phase flow directly collide against the back side of the fixed blade 23 when passing through the fixed blade inlet window 22 between the fixed blades 23.

Regarding the above-described two factors, since the fixed blades 23 are formed of an iron plate whose repulsive force is relatively high, the coarse particles Pc, Pd collided against the back side of the fixed blades 23 rebound to the vicinity of the outer surface of the inner cylinder 24, and then, stall. That is, some of the coarse particles in the solid-gas two-phase flow having passed through the fixed blade inlet window 22 between the fixed blades 23 collide against the back surfaces of the fixed blades 23. Such coarse particles receive a relatively-high repulsive force to move to the vicinity of the outer surface of the inner cylinder 24, and then, stall. For this reason, the above-described coarse particles Pc, Pd drop down along the outer surface of the inner cylinder 24 due to the force of gravity.

However, while dropping down, the coarse particles Pc, Pd ride on an upward fine particle delivery air flow toward the inside (the pulverized coal outlets 16) of the inner cylinder 24 as indicated by solid arrows in FIG. 8(*b*).

As a result, it is assumed that the coarse particles Pc, Pd having collided against the back side of the fixed blades 23 stall in the vicinity of the outer surface of the inner cylinder 24 and then, flow out through the pulverized coal outlets 16 together with the fine particles. Outflow of the coarse particles Pc, Pd is not preferable because such outflow lowers the separation efficiency of the fixed separator 20.

With tight global energy resource conditions, the needs for utilization of inexpensive low-grade coal have recently increased. It has been expected that a fixed separator can be applied as a separator for low-grade coal having relatively-favorable combustibility.

Moreover, coal-fired boilers have required a higher efficiency (reduction in unburnt combustibles in ash) and lower-NOx fuel, and have also required fixed separator capable of reducing the proportion of coarse particles in product pulverized coal.

The present invention has been made in view of the above-described situations, and is intended to reduce, in a vertical roller mill equipped with a fixed separator, the proportion of coarse particles in product pulverized coal (i.e., the proportion of coarse particles having a size of over 100 mesh and providing an adverse effect to combustibility).

Solution to Problem

In order to solve the above-described problem, the present invention employs the following solution.

A first aspect of the present invention is a vertical roller mill comprising, in a housing, a fixed cyclone separator configured to separate, when a solid-gas two-phase flow for delivering powder obtained by pulverization of a solid passes through the fixed cyclone separator, fine powder having a small particle size by centrifugal force to flow out to the outside. The fixed cyclone separator is configured such that after the solid-gas two-phase flow is introduced into the fixed cyclone separator through a fixed blade inlet window opening at a cone-shaped member, the fine powder is flowed out from an upper outlet to the outside by way of a lower end portion of an inner cylinder provided inside the cone-shaped member by swirling the solid-gas two-phase flow by a fixed blade attached to a vicinity of the fixed blade inlet window inside the fixed blade inlet window, and a surface layer having a higher coefficient of rebound of a collided particle than that of an iron plate surface is formed on an outer surface of the inner cylinder.

According to such a configuration, since the surface layer having a higher coefficient of rebound (i.e., coefficient of restitution) of the collided particle than that of the iron plate surface is formed on the outer surface of the inner cylinder, coarse particles collided against the outer surface of the inner cylinder in the solid-gas two-phase flow having passed between the fixed blades sufficiently (greatly) rebound as compared to a conventional iron plate. As a result, a decrease (stalling) in the velocity of the coarse particles can be prevented or suppressed.

In this case, preferable examples of the surface layer include ceramics having a higher hardness and being resistant to abrasion due to collision of coarse particles.

A second aspect of the present invention is a vertical roller mill comprising, in a housing, a fixed cyclone separator configured to separate, when a solid-gas two-phase flow for delivering powder obtained by pulverization of a solid passes through the fixed cyclone separator, fine powder having a small particle size by centrifugal force to flow out to the outside. The fixed cyclone separator is configured such that after the solid-gas two-phase flow is introduced into the fixed cyclone separator through a fixed blade inlet window opening at a cone-shaped member, the fine powder is flowed out from an upper outlet to the outside by way of a lower end portion of an inner cylinder provided inside the cone-shaped member by swirling the solid-gas two-phase flow by a fixed blade attached to a vicinity of the fixed blade inlet window inside the fixed blade inlet window, and many inclined surfaces configured to rebound a collided particle in the direction away from an outer surface of the inner cylinder and formed into a continuous asperity in a circumferential direction are provided on the outer surface of the inner cylinder.

According to such a configuration, since many inclined surfaces configured to rebound the collided particle in the direction away from the outer surface and formed into the continuous asperity in the circumferential direction are provided on the outer surface of the inner cylinder, coarse particles collided against the outer surface of the inner cylinder in the solid-gas two-phase flow having passed between the fixed blades rebound off the inclined surfaces in the direction away from the inner cylinder. Moreover, such coarse particles receive sufficient centrifugal force. Thus, a decrease (stalling) in the velocity of the coarse particles can be prevented or suppressed.

In this case, preferable examples of the inclined surface include inclined surfaces forming a serrated shape on the outer surface of the inner cylinder as viewed in the cross section, and inclined surfaces defined by collision vanes placed on the outer surface of the inner cylinder.

A third aspect of the present invention is a vertical roller mill comprising, in a housing, a fixed cyclone separator configured to separate, when a solid-gas two-phase flow for delivering powder obtained by pulverization of a solid passes through the fixed cyclone separator, fine powder having a small particle size by centrifugal force to flow out to the outside. The fixed cyclone separator is configured such that after the solid-gas two-phase flow is introduced into the fixed cyclone separator through a fixed blade inlet window opening at a cone-shaped member, the fine powder is flowed out from an upper outlet to the outside by way of a lower end portion of an inner cylinder provided inside the cone-shaped member by swirling the solid-gas two-phase flow by a fixed blade attached to a vicinity of the fixed blade inlet window inside the fixed blade inlet window, and an inverted conical reflector is placed between an outer surface of the inner cylinder and the fixed blade inlet window and between the outer surface of the inner cylinder and the fixed blade.

According to such a configuration, since the inverted conical reflector is placed between the outer surface of the inner cylinder and the fixed blade inlet window and between the outer surface of the inner cylinder and the fixed blade, the drop-down velocity of coarse particles collided against the reflector in the solid-gas two-phase flow having passed between the fixed blades increases.

A fourth aspect of the present invention is a vertical roller mill comprising, in a housing, a fixed cyclone separator configured to separate, when a solid-gas two-phase flow for delivering powder obtained by pulverization of a solid passes through the fixed cyclone separator, fine powder having a small particle size by centrifugal force to flow out to the outside. The fixed cyclone separator is configured such that after the solid-gas two-phase flow is introduced into the fixed cyclone separator through a fixed blade inlet window opening at a cone-shaped member, the fine powder is flowed out from an upper outlet to the outside by way of a lower end portion of an inner cylinder provided inside the cone-shaped member by swirling the solid-gas two-phase flow by a fixed blade attached to a vicinity of the fixed blade inlet window inside the fixed blade inlet window, and a surface layer having a lower coefficient of rebound of a collided particle than that of an iron plate surface is formed on a back surface of the fixed blade.

According to such a configuration, since the surface layer having a lower coefficient of rebound of the collided particle than that of the iron plate surface is formed on the back surface of the fixed blade, the magnitude of rebound of a particle directly collided against the back side of the fixed blade and the magnitude of rebound of a particle rebounded and re-collided after collision against the outer surface of the inner cylinder decrease as compared to a conventional iron plate. As a result, particles, in particular coarse particles having a large particle size, having collided against the back side of the fixed blades stall without reaching the vicinity of the inner cylinder, and receive sufficient centrifugal force in the vicinity of the fixed blades attached to the cone-shaped member. Thus, such particles move to an inner wall surface of the cone-shaped member, and drop down.

In this case, preferable examples of the surface layer include copper.

Advantageous Effects of Invention

According to the present invention as described above, a decrease (stalling) in the velocity of coarse particles collided against the outer surface of the cone-shaped member is prevented or suppressed. Thus, the coarse particles move away from the cone-shaped member, and move to the inner surface of the cone-shaped member by sufficient centrifugal force. Consequently, the coarse particles collided against the outer surface of the cone-shaped member drop, without flowing out through a pulverized coal outlet together with fine particles, down onto a mill table, and are pulverized again. Moreover, the drop-down velocity of coarse particles having collided against the reflector increases. Thus, such coarse particles drop, without flowing out through the pulverized coal outlet together with fine particles, down onto the mill table, and are pulverized again.

According to the present invention as described above, the magnitude of rebound of a particle having collided against the back surface of the fixed blade is reduced. Thus, particles such as coarse particles having collided against the back surfaces of the fixed blades stall without reaching the vicinity of the inner cylinder. Such particles receive sufficient centrifugal force in the vicinity of the fixed blades to move to the inner surface of the cone-shaped member, and then, drop down. Thus, the coarse particles having collided against the back surfaces of the fixed blades drop, without flowing out through the pulverized coal outlet together with fine particles, down onto the mill table, and are pulverized again.

As a result, the vertical roller mill comprising the fixed separator according to the present invention can reduce the proportion of coarse particles in product pulverized coal to improve a separation efficiency. Thus, if the vertical roller mill of the present invention is applied to a pulverized coal-fired boiler, the proportion of coarse particles in product pulverized coal can be reduced, and therefore, unburnt combustibles in ash can be reduced. Consequently, a low-cost fixed separator whose maintenance is easy due to a simple structure without a driver can be employed as a separator for low-grade coal having relatively-favorable combustibility. As a result, a coal-fired (pulverized coal-fired) boiler configured to form pulverized coal fuel from inexpensive low-grade coal to use the pulverized coal fuel for combustion can be realized.

BRIEF DESCRIPTION OF DRAWINGS

FIG. 1(*a*) is a cross-sectional view (a cross-sectional view along an A-A line of FIG. 1(*b*)) of the structure around a fixed separator, and FIG. 1(*b*) is a longitudinal sectional view of the structure around the fixed separator.

FIG. 6(*a*) is a cross-sectional view (a cross-sectional view along an A-A line of FIG. 6(*b*)) of the fixed separator, and FIG. 6(*b*) is a longitudinal sectional view of the fixed separator.

FIG. 8(*a*) is a cross-sectional view (a cross-sectional view along a B-B line of FIG. 8(*b*)) of the structure around a fixed separator, and FIG. 8(*b*) is a longitudinal sectional view of the structure around the fixed separator.

DESCRIPTION OF EMBODIMENTS

An embodiment of a vertical roller mill of the present invention will be described below with reference to drawings.

Figure 7:
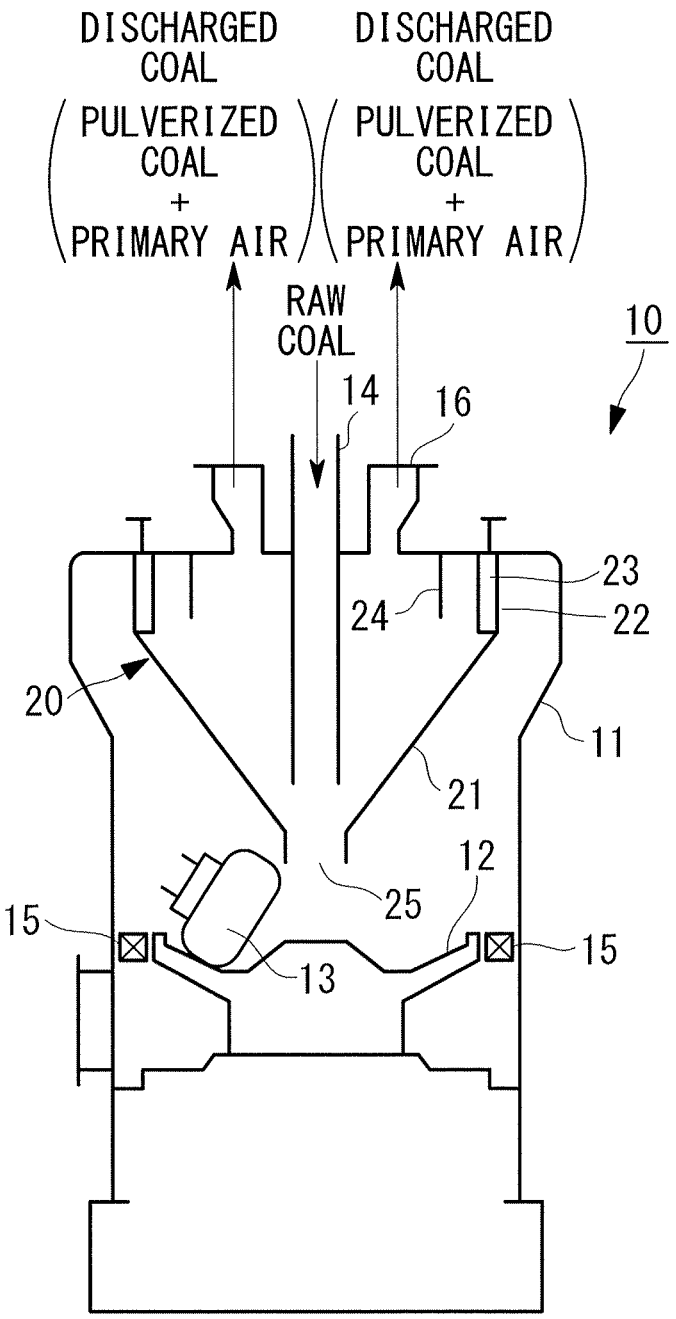
FIG. 7 is a schematic longitudinal sectional view of an example configuration of the vertical roller mill.
Figure 8:
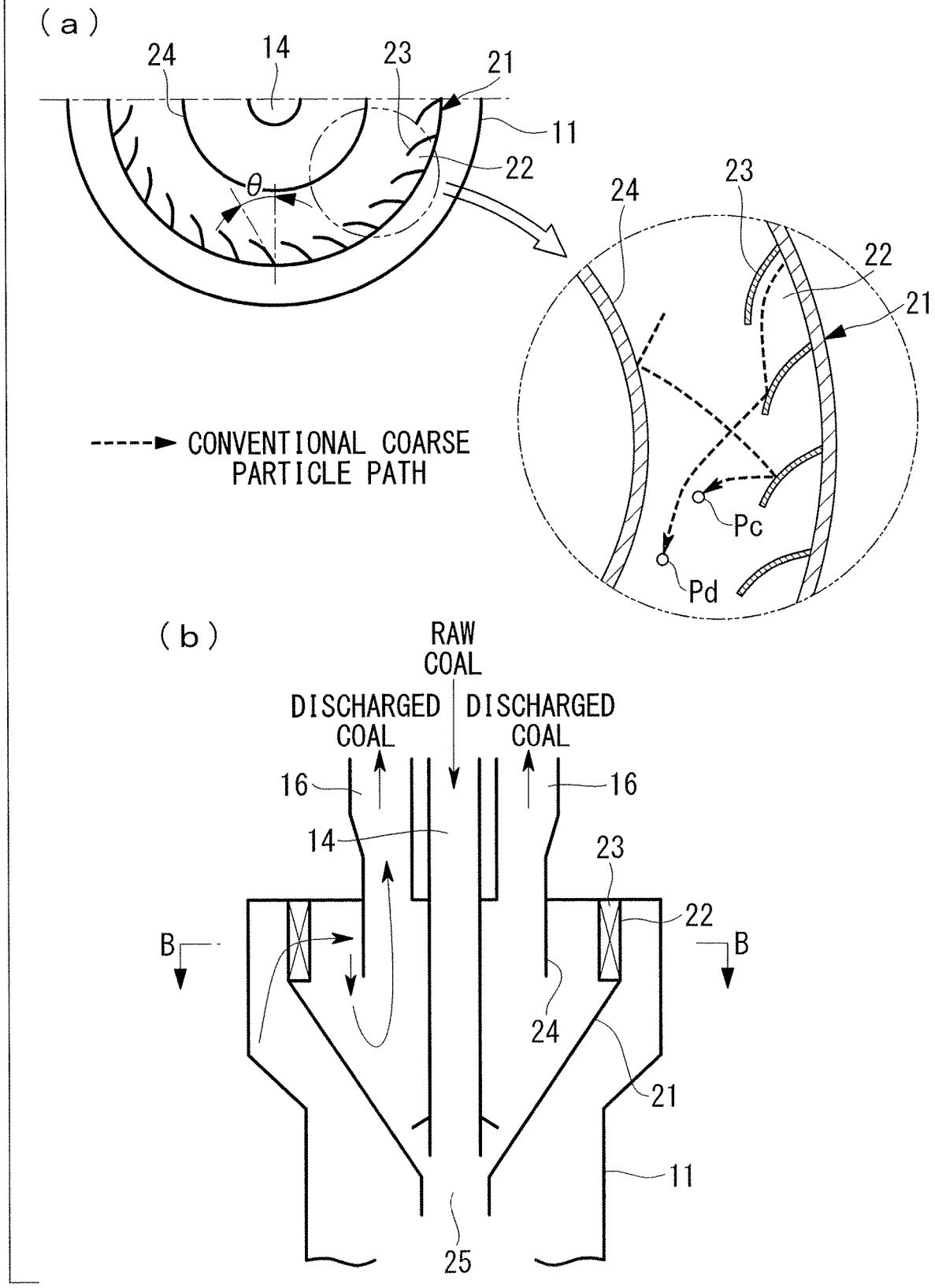
FIGS. 8(*a*) and 8(*b*) are views of a conventional vertical roller mill.

A vertical roller mill 10 illustrated in FIG. 7 is a device (a coal pulverizer) configured to manufacture pulverized coal as fuel for, e.g., a pulverized coal-fired boiler. The vertical roller mill 10 pulverizes raw coal into pulverized coal, and the pulverized coal subjected to gravitational separation is separated by a fixed separator 20. As a result, the product fine powder having separated by passing through the fixed separator 20 is, as pulverized coal fuel having a desired fineness, delivered to the pulverized coal-fired boiler by the flow of primary air through pulverized coal outlets (outlets) 16 provided at an upper portion of the vertical roller mill 10.

Note that the configuration of the vertical roller mill 10 of the present embodiment is similar to that of the above-described conventional technique except for the configuration of the fixed separator 20 described later, and therefore, the detailed description thereof will not be repeated.

That is, the vertical roller mill 10 of the present invention includes, at an upper portion in a housing 11, the fixed cyclone separator 20 configured such that a solid-gas two-phase flow (pulverized coal+primary air) for delivering pulverized coal (powder) obtained by pulverization of raw coal (solid) passes through the fixed separator 20 to separate, using the force of gravity, fine powder having a small particle size to flow out to the pulverized coal-fired boiler (i.e., to the outside). The fixed separator 20 is configured as follows. The solid-gas two-phase flow is introduced into a cone 21, which is a cone-shaped member, through fixed blade inlet windows 22 opening at the cone 21, and fixed blades 23 attached to the vicinity of the fixed blade inlet windows 22 inside the fixed blade inlet windows 22 swirl the solid-gas two-phase flow. In this manner, lightweight fine powder having a small particle size passes through a lower end side of an inner cylinder 24 provided inside the cone 21, and then, flows out from the cone through the pulverized coal outlets 16 provided on the upper side.

In other words, fine powder having a smaller particle size than a desired particle size rides on an inverted upward flow passing through a lower end portion of the inner cylinder 24 provided in the fixed separator 20, and then, is separated. Subsequently, the fine powder flows out through the pulverized coal outlets 16 opening to the upper side. Thus, the fine powder is, as product fine powder (pulverized coal for fuel), supplied from the fixed separator 20 and the vertical roller mill 10 to the pulverized coal-fired boiler.

First Embodiment

Figure 1:
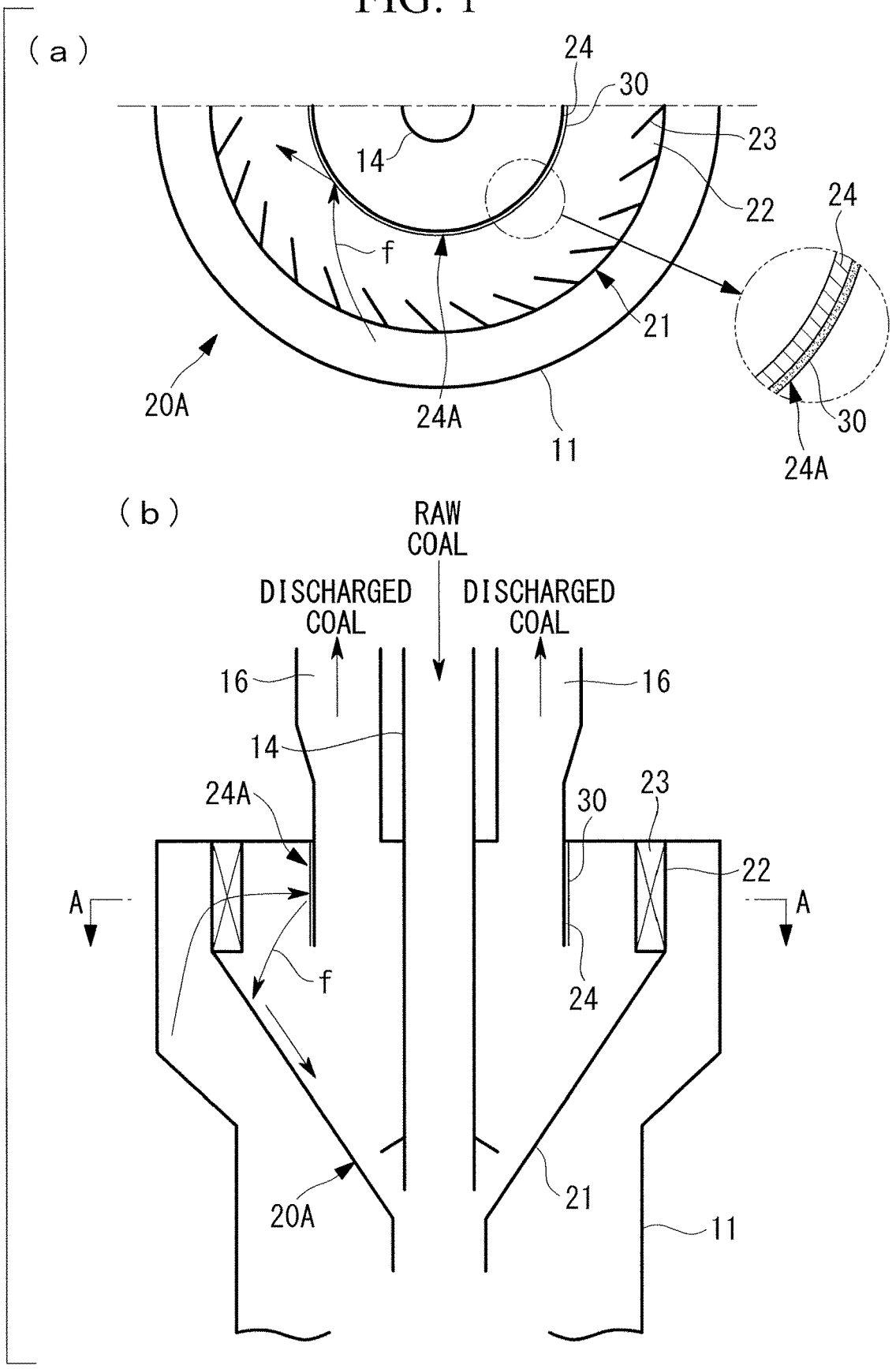
FIGS. 1(*a*) and 1(*b*) are views of a first embodiment of a vertical roller mill of the present invention.

The present embodiment employs a fixed separator 20A configured as illustrated in FIGS. 1(*a*) and 1(*b*), instead of the above-described fixed separator 20. That is, the fixed separator 20A of the present embodiment employs a high repulsiveness inner cylinder 24A having such a bilayer structure that a surface layer 30 made of ceramics is formed on an outer surface of an inner cylinder 24 formed of an iron plate.

The surface layer 30 forms an inner cylinder outer surface exhibiting a higher coefficient of rebound of collided particles than that of an iron plate surface as an outer surface of a conventional inner cylinder. For example, the structure may be employed, in which a ceramics plate having a high hardness is bonded to an outer surface of an inner cylinder formed of an iron plate.

The above-described surface layer 30 has a higher coefficient of rebound of collided particles than that of the iron plate surface. Thus, when some of coarse particles contained in the solid-gas two-phase flow having passed through the fixed blades 23 collide against the surface layer 30 formed on the outer surface of the high repulsiveness inner cylinder 24A, these coarse particles greatly rebound as compared to the conventional iron plate.

As a result, the coarse particles having collided against the surface layer 30 sufficiently move away from the surface layer 30 as the outer surface of the high repulsiveness inner cylinder 24A as indicated by, e.g., arrows f in FIG. 1(*a*), and move to an inner wall surface of the cone 21 by a sufficient centrifugal force of a swirl flow. For this reason, the coarse particles do not stall due to a decrease in velocity.

That is, coarse particles not stalling even if collided against the surface layer 30 do not ride on the inverted upward flow passing through the lower end portion of the high repulsiveness inner cylinder 24A. Accordingly, the coarse particles drop down onto the inclined inner wall surface of the cone 21. These coarse particles drop down along the inner wall surface of the cone 21. Eventually, the coarse particles drop down onto a mill table 12, and are pulverized again.

As described above, stalling of coarse particles having collided against the surface layer 30 is prevented or suppressed. For this reason, such coarse particles do not flow, together with fine particles, out from the pulverized coal outlets 16 by the inverted upward flow. In addition, the coarse particles drop down onto the mill table 12, and are pulverized again. For these reasons, the proportion of coarse particles in product pulverized coal can be reduced, leading, to improvement of a separation efficiency.

Thus, the vertical roller mill 10 including the fixed separator 20A of the present embodiment can be applied to the pulverized coal-fired boiler to reduce the proportion of coarse particles in product pulverized coal. Consequently, unburnt combustibles in ash can be reduced. As a result, the low-cost fixed separator 20A which has a simple structure without a driver and whose maintenance is easy can be employed as a separator for low-grade coal having a relatively-high combustibility.

In the present embodiment, the material forming the surface layer 30 is not limited as long as such a material has a higher coefficient of rebound of particles than that of an iron plate. However, it is desired to employ ceramics having a higher hardness than that of an iron plate, considering that the surface layer 30 is polished and abraded by collision of particles such as coarse particles.

Second Embodiment

Figure 2:
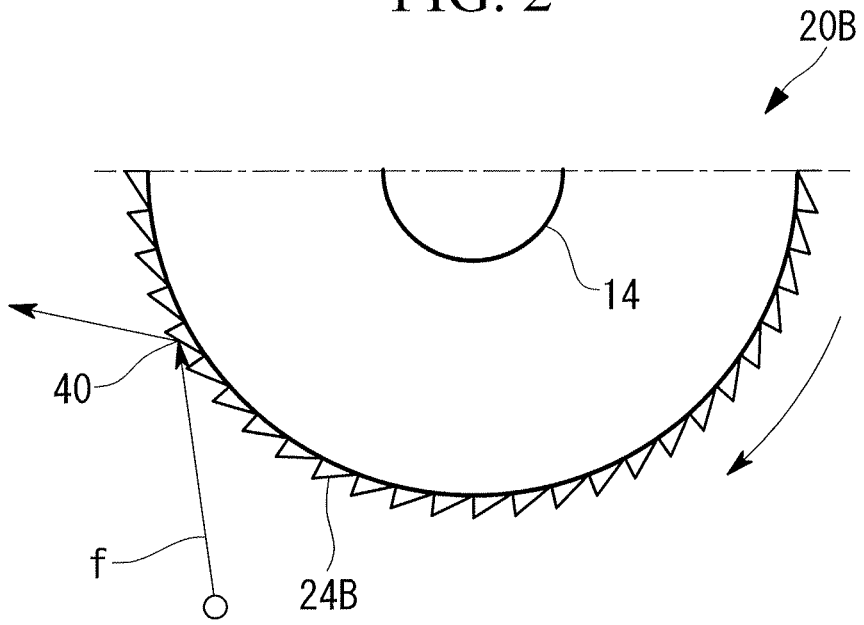
FIG. 2 is a cross-sectional view of a second embodiment of the vertical roller mill of the present invention, illustrating the structure of an outer surface of an inner cylinder.

The present embodiment employs a fixed separator 20B including an inclined face inner cylinder 24B as illustrated in FIG. 2, instead of the above-described fixed separator 20. Note that the configuration of the fixed separator 20B of the present embodiment is similar to that of the above-described conventional example, except for the inclined face inner cylinder 24B.

That is, the fixed separator 20B of the present embodiment includes the inclined face inner cylinder 24B provided with many inclined surfaces 40, the inclined surfaces 40 being formed into a continuous asperity in a circumferential direction on an outer surface of an inner cylinder 24. Each inclined surface 40 of the present embodiment is set at such an angle that collided particles such as coarse particles rebound in the direction away from the outer surface of the inner cylinder 24.

Specifically, the inclination angle of the inclined surface 40 is set at such an inclination angle that coarse particles having collided against the inclined surface 40 rebound toward an inner wall surface of a cone 21, considering the incident angle of a coarse particle as in a coarse particle flow indicated by an arrow f in the figure. That is, since the incident angle of a coarse particle is determined by swirling of a solid-gas two-phase flow by fixed blades 23 through fixed blade inlet windows 22, the inclination angle of the inclined surface 40 may be such an angle that coarse particles having collided against the inclined surface 40 at the above-described incident angle rebound outward.

In the present embodiment illustrated in FIG. 2, the outer surface of the inner cylinder 24 is formed in a serrated shape as viewed in the cross section, and therefore, many inclined surfaces 40 having the same shape are continuously formed into the continuous asperity in the circumferential direction.

Since many inclined surfaces 40 are continuously formed in the circumferential direction to cause collided coarse particles to rebound away from the outer surface of the inner cylinder 24, the coarse particles moving toward the outer surface of the inner cylinder 24 collide, in the solid-gas two-phase flow having passed through the fixed blades 23, against the inclined surfaces 40 of the inclined face inner cylinder 24B to rebound away from the inner cylinder 24. Further, the coarse particles having rebounded away from the inner cylinder 24 move to the inner wall surface of the cone 21 by a sufficient centrifugal force, and therefore, a decrease in the velocity of the coarse particles can be prevented or suppressed.

Thus, coarse particles not stalling even if collided against the inclined surfaces 40 do not ride on an inverted upward flow passing through a lower end portion of the inclined face inner cylinder 24B. Accordingly, the coarse particles drop down onto the inclined inner wall surface of the cone 21. These coarse particles drop down along the inner wall surface of the cone 21. Eventually, the coarse particles drop down onto a mill table 12, and are pulverized again.

As described above, stalling of coarse particles having collided against the inclined surfaces 40 is prevented or suppressed. For this reason, such coarse particles do not flow, together with fine particles, out from pulverized coal outlets 16 by the inverted upward flow. In addition, the coarse particles drop down onto the mill table 12, and are pulverized again. For these reasons, the proportion of coarse particles in product pulverized coal can be reduced, leading to improvement of a separation efficiency.

Figure 3:
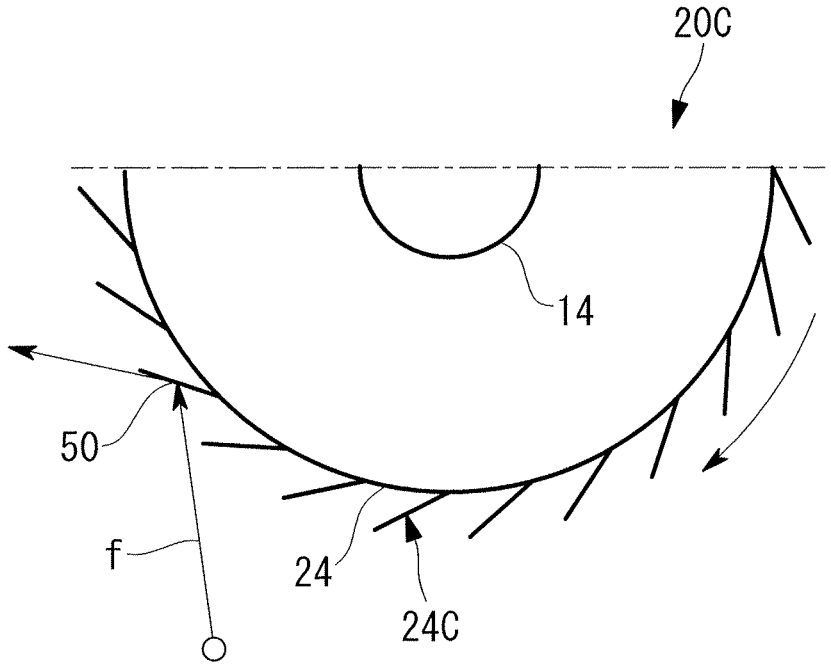
FIG. 3 is a cross-sectional view of a variation of the vertical roller mill illustrated in FIG. 2, illustrating the structure of the outer surface of the inner cylinder.

The above-described inclined face inner cylinder 24B is not limited to the structure in which the outer surface of the inner cylinder 24 is in the serrated shape as viewed in the cross section. For example, the inclined face inner cylinder 24B may employ a variation in which many collision vanes 50 forming inclined surfaces on an inner cylinder 24 are placed as in an inclined face inner cylinder 24C and forming a fixed separator 20C illustrated in FIG. 3.

Even with the inclined face inner cylinder 24C having the inclined surfaces of the collision vanes 50, the collision vanes 50 function similarly to the inclined surfaces 40, and therefore, the similar features and advantageous effects to those of the above-described inclined face inner cylinder 24B can be realized.

Third Embodiment

Figure 4:
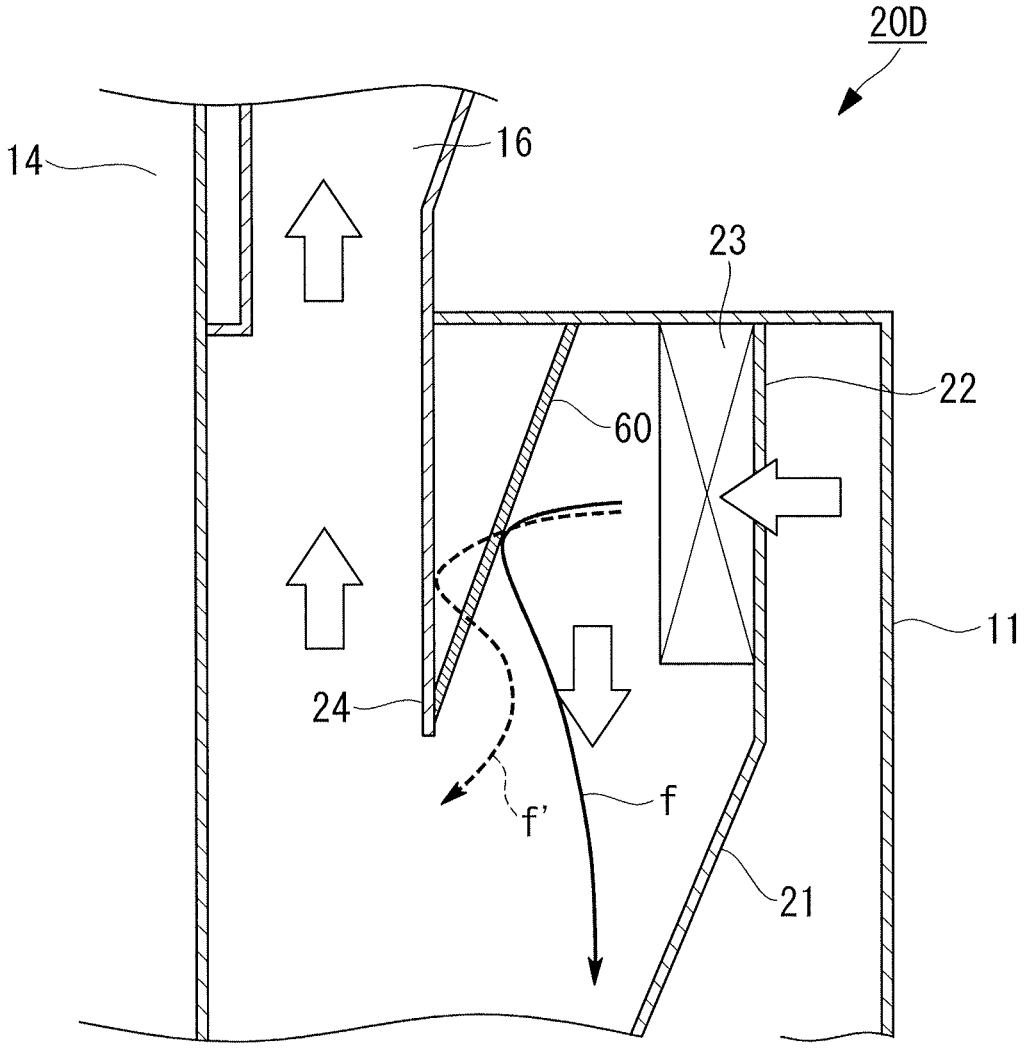
FIG. 4 is a longitudinal sectional view of a third embodiment of the vertical roller mill of the present invention, illustrating the structure around a fixed separator.

The present embodiment employs a fixed separator 20D in which an inverted conical reflector 60 is placed between an outer surface of an inner cylinder 24 and fixed blade inlet windows 22 and between the outer surface of the inner cylinder 24 and fixed blades 23 as illustrated in FIG. 4, instead of the above-described fixed separator 20. Note that the configuration of the fixed separator 20D of the present embodiment is similar to that of the above-described conventional example, except for the reflector 60.

The reflector 60 is an inverted conical plate member placed across the entire periphery in a cone 21, and forms an inclined surface extending downward to the horizontal direction.

Thus, in a solid-gas two-phase flow having passed through the fixed blades 23, coarse particles having collided against the reflector 60 rebound in a drop-down direction as indicated by a solid arrow f in FIG. 4, leading to an increase in the velocity of the coarse particles.

That is, in the case of not providing the reflector 60, coarse particles having rebounded by the outer surface of the inner cylinder 24 have, as indicated by a dashed arrow f' in FIG. 4, a smaller velocity component in the downward direction as compared to the case of collision against the reflector 60. For this reason, such coarse particles are easily mixed with an inverted upward flow passing through a lower end portion of the inner cylinder 24.

However, since the reflector 60 is provided in the cone 21, the velocity of coarse particles having collided against the reflector 60 in the drop-down direction increases after rebounding, and as a result, such coarse particles do not ride on the inverted upward flow and drop down onto an inclined inner wall surface of the cone 21. These coarse particles further drop down along the inner wall surface of the cone 21. Eventually, the coarse particles drop down onto a mill table 12, and are pulverized again.

As described above, since the drop-down velocity of coarse particles having collided against the reflector 60 increases, such coarse particles do not flow, together with fine particles, out from pulverized coal outlets 16 by the inverted upward flow. Moreover, these coarse particles drop down onto the mill table 12, and are pulverized again. For this reason, the proportion of coarse particles in product pulverized coal can be reduced, leading to improvement of a separation efficiency.

Fourth Embodiment

Figure 5:
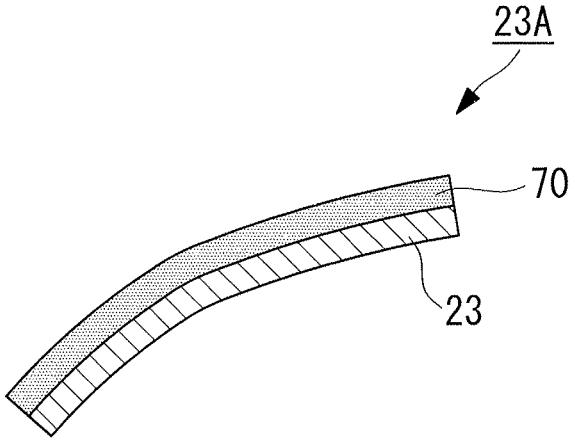
FIG. 5 is a cross-sectional view of a fourth embodiment of the vertical roller mill of the present invention, illustrating the cross-sectional shape of a fixed blade forming a fixed separator.
Figure 6:
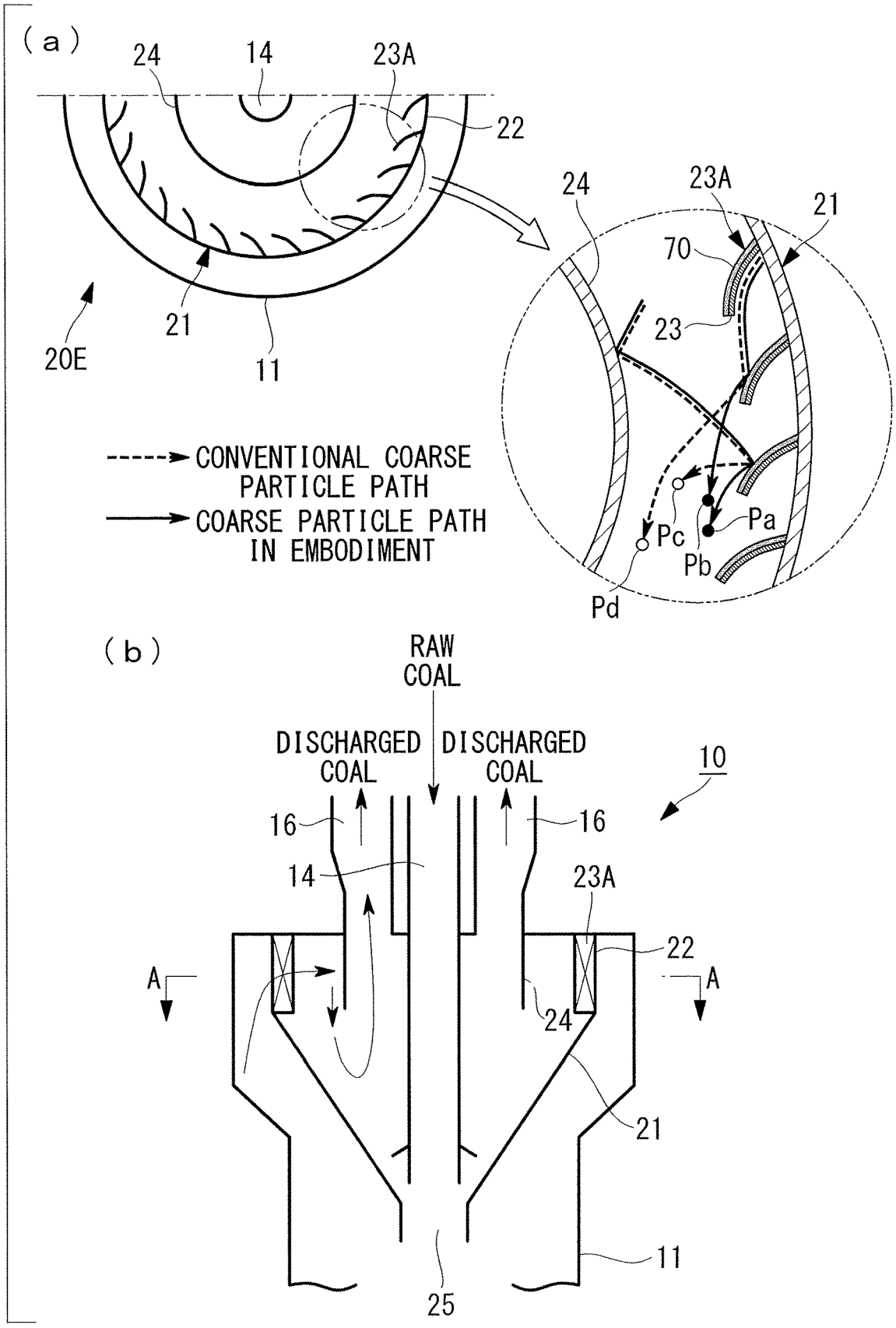
FIGS. 6(*a*) and 6(*b*) are views of features and advantageous effects of the fixed separator including the fixed blades having the cross-sectional shape illustrated in FIG. 5.

The present embodiment employs a fixed separator 20E configured as illustrated in FIGS. 5, 6(*a*), and 6(*b*), instead of the above-described fixed separator 20. That is, in the fixed separator 20E of the present embodiment, a low-repulsive fixed blade 23A is used, in which a low repulsiveness layer 70 made of a material (a low-repulsive material) having a lower coefficient of rebound than that of an iron plate is formed on a back side of each fixed blade 23.

The low-repulsive fixed blade 23A illustrated in the figures has a bilayer structure of the fixed blade 23 formed of an iron plate and the low repulsiveness layer 70. Specifically, the low repulsiveness layer 70 is formed in such a manner that the low-repulsive material is bonded to the back side of the fixed blade 23 on which the fixed blade 23 protrudes in a raised shape, for example. In this case, the low-repulsive material preferably has a lower coefficient of rebound than that of an iron plate, as well as having a high hardness so that the low repulsiveness layer 70 is resistant to abrasion due to collision of particles.

In the fixed separator 20E as described above, some of coarse particles Pa contained in a solid-gas two-phase flow having passed through the low-repulsive fixed blades 23A collide against an outer surface of an inner cylinder 24, and then, rebound. These coarse particles Pa greatly rebound and move toward the low-repulsive fixed blades 23A side, and therefore, re-collide against the low repulsiveness layers 70 each formed on the back side of a corresponding one of the low-repulsive fixed blades 23A. However, since the low repulsiveness layer 70 is set to have a lower coefficient of rebound of collided particles than that of an iron plate surface, the magnitude (a reachable distance from a rebounding surface) of rebound of the coarse particle Pa is less than that in the case of a conventional iron plate surface, and the coarse particles Pa stall without reaching the vicinity of the outer surface of the inner cylinder 24.

Some of coarse particles Pb contained in the solid-gas two-phase flow having passed through the low-repulsive fixed blades 23A directly collide against the low repulsiveness layers 70 each formed on the back surface of a corresponding one of the low-repulsive fixed blades 23A, and then, rebound. However, since the low repulsiveness layer 70 is set to have a lower coefficient of rebound of collided particles than that of an iron plate surface, the magnitude of rebound of the coarse particle Pb is less than that in the case of a conventional iron plate surface, and the coarse particles Pb stall without reaching the vicinity of the outer surface of the inner cylinder 24.

As a result, the stalled coarse particles Pa, Pb ride on a swirl flow formed in the vicinity of the low-repulsive fixed blades 23A attached to a cone 21, thereby receiving a sufficient centrifugal force. Thus, the stalled coarse particles Pa, Pb move to an inner wall surface of the cone 21 by the centrifugal force, and drop down onto a mill table 12 along the inner wall surface of the cone 21.

That is, the coarse particles Pa, Pb having collided against the low repulsiveness layers 70 receive the centrifugal force to move to the inner wall surface of the cone 21, and then, drop down onto the mill table 12 along the inner wall surface of the cone 21. Thus, the coarse particles Pa, Pb do not ride on an inverted upward flow passing through a lower end portion of the inner cylinder 24. Eventually, the coarse particles Pa, Pb drop down onto the mill table 12, and are pulverized again.

As described above, the coarse particles Pa, Pb having collided against the low repulsiveness layers 70 do not flow, together with fine particles, out from pulverized coal outlets 16 by the inverted upward flow due to a decrease in the magnitude of rebound. Further, such coarse particles Pa, Pb drop down onto the mill table 12, and are pulverized again. For this reason, the proportion of coarse particles in product pulverized coal can be reduced, leading to improvement of a separation efficiency. Further, the separation efficiency can be improved without changing the angle and shape of the fixed blade 23.

Note that in the present embodiment, the material forming the low repulsiveness layer 70 is not limited as long as such a material has a lower coefficient of rebound of particles than that of an iron plate. However, the low repulsiveness layer 70 preferably employs a material having a higher hardness than that of an iron plate, considering that the low repulsiveness layer 70 is constantly polished (abraded) due to collision of particles such as coarse particles.

According to the above-described embodiments and variations thereof, the vertical roller mill 10 including any of the fixed separators 20A to 20E can reduce the proportion of coarse particles in product pulverized coal (e.g., the proportion of coarse particles having a size of over 100 mesh). Thus, if the vertical roller mill 10 is applied to the pulverized coal-fired boiler, the proportion of coarse particles in product pulverized coal can be reduced, and therefore, unburnt combustibles in ash can be reduced. Consequently, any of the low-cost fixed separators 20A to 20E which have a simple structure without a driver and whose maintenance is easy can be employed as a separator for low-grade coal having relatively-favorable combustibility. As a result, a pulverized coal-fired boiler configured to form pulverized coal fuel from inexpensive low-grade coal to use the pulverized coal fuel for combustion can be realized.

Note that the present invention is not limited to the above-described embodiments, and modification can be optionally made without departing from the scope of the present invention.

REFERENCE SIGNS LIST

10 vertical roller mill
11 housing
12 mill table
13 mill roller
14 coal feed tube
15 throat
16 pulverized coal outlet (outlet)
20, 20A to 20E fixed separators
21 cone
22 fixed blade inlet window
23 fixed blade
24 inner cylinder
24A high repulsiveness inner cylinder
24B, 24C inclined face inner cylinders
30 surface layer
40 inclined surface
50 collision vane
60 reflector
70 low repulsiveness layer

The invention claimed is:

1. A vertical roller mill comprising, in a housing, a fixed cyclone separator configured to separate, when a solid-gas two-phase flow for delivering powder obtained by pulverization of a solid passes through the fixed cyclone separator, fine powder having a small particle size by centrifugal force to flow out to an outside, wherein the fixed cyclone separator is configured such that after the solid-gas two-phase flow is introduced into the fixed cyclone separator through a fixed blade inlet window opening at a cone-shaped member, the fine powder is flowed out from an upper outlet to the outside by way of a lower end portion of an inner cylinder provided inside the cone-shaped member by swirling the solid-gas two-phase flow by a fixed blade attached to a vicinity of the fixed blade inlet window inside the fixed blade inlet window, and a surface layer made of copper is formed on a back surface of the fixed blade.

* * * * *